US006626008B1

(12) United States Patent
Prosser et al.

(10) Patent No.: US 6,626,008 B1
(45) Date of Patent: Sep. 30, 2003

(54) COLD COMPRESSION CRYOGENIC RECTIFICATION SYSTEM FOR PRODUCING LOW PURITY OXYGEN

(75) Inventors: Neil Mark Prosser, Lockport, NY (US); Minish Mahendra Shah, East Amherst, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/316,095

(22) Filed: Dec. 11, 2002

(51) Int. Cl.[7] ..... F25J 3/04
(52) U.S. Cl. ..... 62/654
(58) Field of Search ..... 62/617, 640, 643, 62/644, 653, 654, 902, 903, 905

(56) References Cited

U.S. PATENT DOCUMENTS

| | | | | | |
|---|---|---|---|---|---|
| 4,254,629 | A | * | 3/1981 | Olszewski | 62/13 |
| 5,337,570 | A | | 8/1994 | Prosser | 62/25 |
| 5,463,871 | A | | 11/1995 | Cheung | 62/38 |
| 5,475,980 | A | | 12/1995 | Grenier et al. | 62/24 |
| 5,582,036 | A | | 12/1996 | Drnevich et al. | 62/656 |
| 5,628,207 | A | | 5/1997 | Howard et al. | 62/646 |
| 5,669,236 | A | * | 9/1997 | Billingham et al. | 62/643 |
| 5,678,427 | A | * | 10/1997 | Bonaquist et al. | 62/650 |
| 5,682,766 | A | | 11/1997 | Bonaquist et al. | 62/646 |
| 5,836,174 | A | * | 11/1998 | Billingham et al. | 62/643 |
| 5,839,296 | A | | 11/1998 | Bonaquist et al. | 62/650 |
| 5,901,576 | A | | 5/1999 | Agrawal et al. | 62/646 |
| 5,916,262 | A | | 6/1999 | Prosser et al. | 62/646 |
| 6,178,775 | B1 | | 1/2001 | Higginbotham et al. | 62/646 |
| 6,279,344 | B1 | | 8/2001 | Drnevich et al. | 62/646 |

* cited by examiner

*Primary Examiner*—Henry Bennett
*Assistant Examiner*—Malik N. Drake
(74) *Attorney, Agent, or Firm*—Stanley Ktorides

(57) ABSTRACT

A cryogenic rectification system for producing low purity oxygen from an auxiliary column to a double column system wherein the auxiliary column is reboiled by fluid taken from an intermediate level of the higher pressure column or by a portion of cooled feed air which is cold compressed to a higher pressure prior to the reboiling.

13 Claims, 4 Drawing Sheets

COLD COMPRESSION CRYOGENIC RECTIFICATION SYSTEM FOR PRODUCING LOW PURITY OXYGEN

TECHNICAL FIELD

This invention relates generally to the cryogenic rectification of feed air and, more particularly, to the cryogenic rectification of feed air to produce low purity oxygen.

BACKGROUND ART

The demand for low purity oxygen is increasing in applications such as glassmaking, steelmaking and energy production. Low purity oxygen is generally produced in large quantities by the cryogenic rectification of feed air. However, conventional cryogenic rectification systems for producing low purity oxygen are relatively inefficient.

Accordingly it is an object of this invention to provide a cryogenic rectification system which can more efficiently produce low purity oxygen.

SUMMARY OF THE INVENTION

The above and other objects, which will become apparent to one skilled in the art upon a reading of this disclosure, are attained by the present invention, one aspect of which is:

A method for producing low purity oxygen comprising:

(A) passing feed air into a higher pressure column and separating the feed air within the higher pressure column by cryogenic rectification into nitrogen-enriched fluid and oxygen-enriched fluid;

(B) passing nitrogen-enriched fluid and oxygen-enriched fluid from the higher pressure column into a lower pressure column and producing oxygen-richer fluid by cryogenic rectification within the lower pressure column;

(C) passing oxygen-richer fluid into the upper portion of an auxiliary column and producing low purity oxygen fluid in the lower portion of the auxiliary column;

(D) withdrawing reboiling fluid from an intermediate level of the higher pressure column, increasing the pressure of the withdrawn reboiling fluid by cold compression, and vaporizing a portion of the low purity oxygen fluid by indirect heat exchange with the increased pressure withdrawn reboiling fluid; and (E) recovering low purity oxygen fluid from the lower portion of the auxiliary column as product low purity oxygen.

Another aspect of the invention is:

Apparatus for producing low purity oxygen comprising:

(A) a higher pressure column and means for passing feed air into the higher pressure column;

(B) a lower pressure column and means for passing fluid from the higher pressure column into the lower pressure column;

(C) an auxiliary column having a bottom reboiler, and means for passing fluid from the lower portion of the lower pressure column into the upper portion of the auxiliary column;

(D) a cold compressor, means for passing fluid from an intermediate level of the higher pressure column to the cold compressor, and means for passing fluid from the cold compressor to the auxiliary column bottom reboiler; and (E) means for recovering product low purity oxygen from the lower portion of the auxiliary column.

A further aspect of the invention is:

A method for producing low purity oxygen comprising:

(A) cooling feed air in a main heat exchanger to produce cooled feed air, passing a portion of the cooled feed air into a higher pressure column, and separating the feed air within the higher pressure column by cryogenic rectification into nitrogen-enriched fluid and oxygen-enriched fluid;

(B) passing nitrogen-enriched fluid and oxygen-enriched fluid from the higher pressure column into a lower pressure column and producing oxygen-richer fluid by cryogenic rectification within the lower pressure column;

(C) passing oxygen-richer fluid into the upper portion of an auxiliary column and producing low purity oxygen fluid in the lower portion of the auxiliary column;

(D) increasing the pressure of another portion of the cooled feed air by cold compression, and vaporizing a portion of the low purity oxygen fluid by indirect heat exchange with the increased pressure feed air portion; and (E) recovering low purity oxygen fluid from the lower portion of the auxiliary column as product low purity oxygen.

Yet another aspect of the invention is:

Apparatus for producing low purity oxygen comprising:

(A) a main heat exchanger, a higher pressure column, means for passing feed air to the main heat exchanger, and means for passing feed air from the main heat exchanger to the higher pressure column;

(B) a lower pressure column and means for passing fluid from the higher pressure column into the lower pressure column;

(C) an auxiliary column having a bottom reboiler, and means for passing fluid from the lower portion of the lower pressure column into the upper portion of the auxiliary column;

(D) a cold compressor, means for passing feed air from the main heat exchanger to the cold compressor, and means for passing feed air from the cold compressor to the auxiliary column bottom reboiler; and (E) means for recovering product low purity oxygen from the lower portion of the auxiliary column.

As used herein, the term "feed air" means a mixture comprising primarily oxygen and nitrogen, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

The term "double column" is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluids into heat exchange relation without any physical contact or intermixing of the fluids with each other.

As used herein, the term "subcooling" means cooling a liquid to be at a temperature lower than the saturation temperature of that liquid for the existing pressure.

As used herein, the term "top" when referring to a column means that section of the column above the column mass transfer internals, i.e. trays or packing.

As used herein, the term "bottom" when referring to a column means that section of the column below the column mass transfer internals, i.e. trays or packing.

As used herein, the term "reboiler" means a heat exchange device that generates column upflow vapor from column liquid. A reboiler may be located within or outside of the column. A bottom reboiler generates column upflow vapor from liquid from the bottom of a column. An intermediate reboiler generates column upflow vapor from liquid from above the bottom of a column.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the midpoint of the column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "low purity oxygen" means a fluid having an oxygen concentration within the range of from 70 to 98 mole percent.

As used herein, the term "cold compressor" means a device for raising the pressure of a vapor in which both the inlet and discharge streams are below ambient temperature.

As used herein, the term "cold compression" means a process using a cold compressor for raising the pressure of a subambient temperature vapor stream requiring energy input.

DETAILED DESCRIPTION

The invention will be described in detail with reference to the Drawings.

Figure 1:
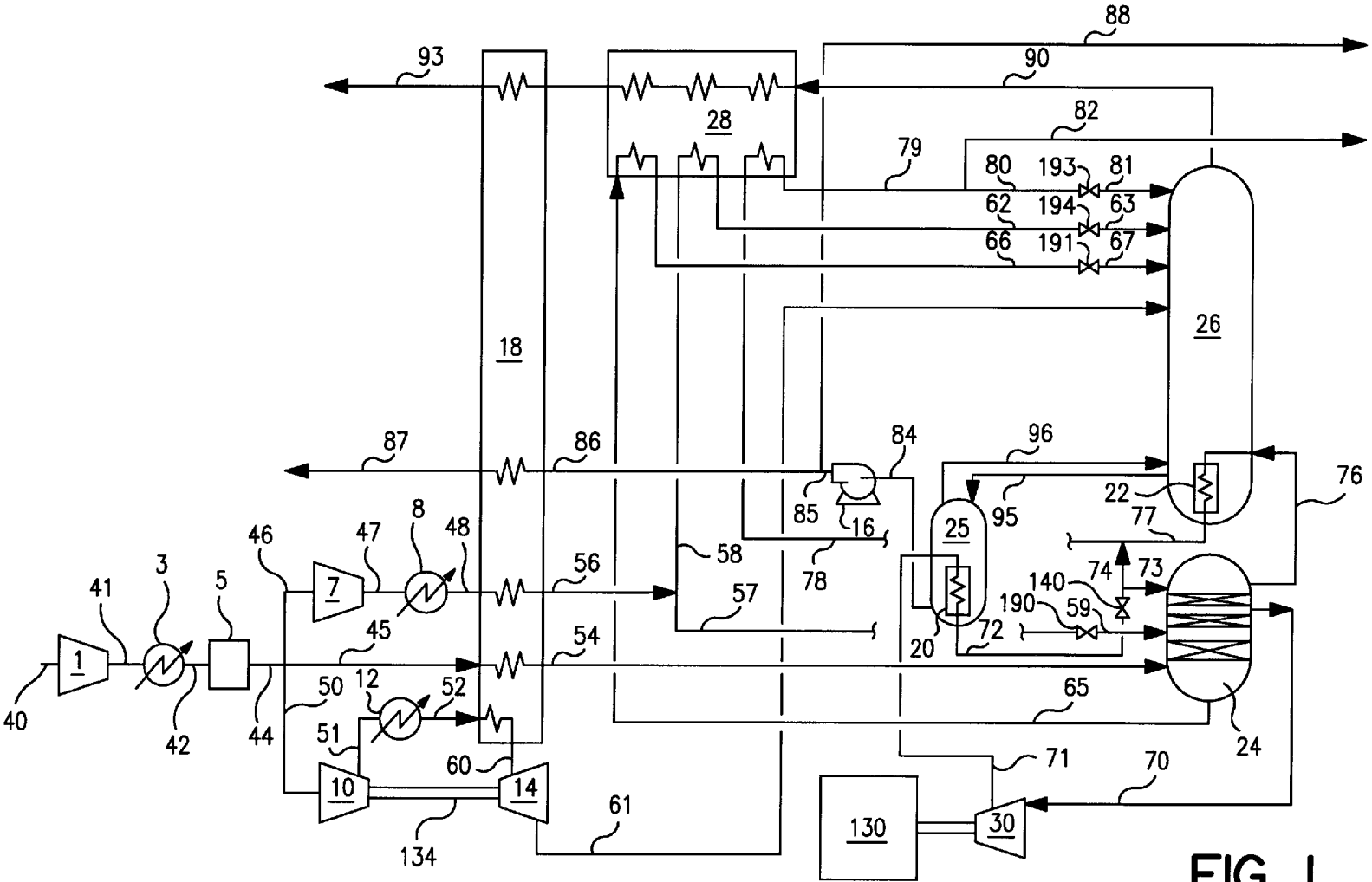
FIG. 1 is a schematic representation of one preferred embodiment of the low purity oxygen cryogenic rectification system of this invention.

Referring now to FIG. 1, feed air 40 is compressed in feed air base load compressor 1 to a pressure generally within the range of from 40 to 65 pounds per square inch absolute (psia). Compressed feed air 41 is cooled of the heat of compression in aftercooler 3 and passed in stream 42 to purifier 5 wherein it is cleaned of high boiling impurities such as water vapor, carbon dioxide and hydrocarbons. Resulting cleaned feed air stream 44 is divided into three portions designated 45, 46 and 50. About 20 to 40 percent of feed air 40 is passed in stream 50 to compressor 10 wherein it is compressed to a pressure generally within the range of from 45 to 90 psia. Resulting compressed feed air portion 51 is cooled of the heat of compression by passage through cooler 12 and resulting stream 52 is further cooled by partial traverse of main heat exchanger 18 by indirect heat exchange with return streams. Resulting feed air stream 60 is then turboexpanded by passage through turboexpander 14 to generate refrigeration and resulting turboexpanded feed air stream 61 is passed into lower pressure column 26. The operation of turboexpander 14 serves to drive compressor 10 through shaft 134.

About 24 to 35 percent of feed air 40 is passed in stream 46 to compressor 7 wherein it is compressed to a pressure sufficient to vaporize pumped liquid oxygen in stream 86 as will be more fully described below. This pressure may be within the range of from 75 to 1400 psia. Resulting compressed feed air portion 47 is cooled of the heat of compression by passage through cooler 8 and resulting stream 48 is cooled by passage through main heat exchanger 18 by indirect heat exchange with return streams. Preferably stream 48 is partially condensed, most preferably totally condensed, by passage through main heat exchanger 18. Resulting feed air stream 56 is divided into streams 57 and 58. Stream 57 is passed through valve 190 and as stream 59 into higher pressure column 24. Stream 58 is passed through valve 194 and as stream 63 into lower pressure column 26. Preferably, as shown in FIG. 1, stream 58 is subcooled, such as by passage through heat exchanger 28, and passed in stream 62 to valve 194, prior to being passed into lower pressure column 26 in stream 63. The remaining portion of feed air 40 is passed as stream 45 through main heat exchanger 18 wherein it is cooled by indirect heat exchange with return streams and resulting cooled feed air stream 54 is passed into higher pressure column 24.

First or higher pressure column 24 is operating at a pressure generally within the range of from 35 to 60 psia. Within higher pressure column 24 the feed air is separated by cryogenic rectification into nitrogen-enriched vapor and oxygen-enriched liquid. Oxygen-enriched liquid is withdrawn from the lower portion of column 24 in stream 65, subcooled by passage through heat exchanger 28, passed in stream 66 through valve 191 and, as stream 67, passed into lower pressure column 26. Nitrogen-enriched vapor is withdrawn from the upper portion of column 24 in stream 76 and passed into reboiler 22 wherein it is condensed by indirect heat exchange with oxygen-richer fluid. Resulting nitrogen-enriched liquid 77 is combined with stream 74 as will be more fully described below to form stream 78. Stream 78 is subcooled by passage through heat exchanger 28 to form stream 79. If desired, a portion 82 of stream 79 may be recovered as product liquid nitrogen. The remainder, which could be all, of stream 79 is passed as stream 80 through valve 193 and, as stream 81, passed into lower pressure column 26 as reflux.

Second or lower pressure column 26 is operating at a pressure less than that of higher pressure column 10 and generally within the range of from 17 to 25 psia. Within lower pressure column 26 the various feeds are separated by cryogenic rectification into nitrogen-richer fluid and oxygen-richer fluid. Nitrogen-richer fluid is withdrawn from the upper portion of column 26 as vapor stream 90, warmed by passage through heat exchangers 28 and 18, and removed from the system in stream 93 which may be recovered in whole or in part as product nitrogen.

Oxygen-richer fluid, having an oxygen concentration generally within the range of from 50 to 80 mole percent, is passed from the lower portion of lower pressure column 26 into the upper portion of an auxiliary column. In the embodiment of the invention illustrated in FIG. 1, oxygen-richer liquid is withdrawn from column 26 in stream 95 and passed into the upper portion of auxiliary column 25 which has a bottom reboiler 20.

The oxygen-richer liquid flows down auxiliary column 25 against upflowing vapor and in the process more volatile components (primarily nitrogen) are stripped out from the downflowing liquid into the upflowing vapor. By this cryogenic rectification stripping process the downflowing liquid forms low purity oxygen liquid at the bottom of auxiliary column 25. Vapor from the top of auxiliary column 25 is passed back to lower pressure column 26 in stream 96.

Reboiling fluid, having a nitrogen concentration within the range of from 90 to 99 mole percent, is withdrawn from an intermediate level of higher pressure column 24. The intermediate level is below the top of column 24, generally from 1 to 15 equilibrium stages, most preferably from 2 to 8 equilibrium stages, below the top of column 24. Vapor stream 70 is passed to cold compressor 30 wherein it is cold compressed to a pressure such that the condensation temperature of resulting cold compressed stream 71 is above the temperature of the boiling low purity oxygen at the bottom of auxiliary column 25. Generally the pressure of stream 70 is increased by at least 10 psi by the cold compression. Typically the pressure of cold compressed stream 71 is within the range of from 45 to 90 psia. In the embodiment of the invention illustrated in FIG. 1, cold compressor 30 is driven by motor 130. Alternatively some or all of the power to drive cold compressor 30 could come from work done by a turboexpander such as turboexpander 14.

Cold compressed reboiling fluid 71 is passed to bottom reboiler 20 wherein it is condensed by indirect heat exchange with low purity oxygen liquid. A portion of the low purity oxygen liquid is vaporized by this heat exchange to provide the upflowing vapor for the operation of auxiliary column 25. Resulting condensed reboiling fluid is withdrawn from bottom reboiler 20 in stream 72 and reduced in pressure by passage through valve 140. A major portion 73 of the resulting reboiling fluid from valve 140 is passed into higher pressure column 24, preferably as shown in FIG. 1, at the top of column 24. The top of a column is the volume above the topmost equilibrium stage. A minor portion 74 of the reboiling fluid from valve 140 may be combined with stream 77 to form stream 78 and is processed as was previously described.

Low purity oxygen fluid is withdrawn from the lower portion of auxiliary column 25 and recovered. The low purity oxygen fluid may be withdrawn from auxiliary column 25 as either vapor or liquid. The embodiment of the invention illustrated in FIG. 1 is a preferred embodiment wherein low purity oxygen fluid is withdrawn as liquid from the lower portion of auxiliary column 25 in stream 84 and increased in pressure to form pumped liquid low purity oxygen stream 85 by passage through liquid pump 16. If desired, a portion of stream 85 may be recovered as liquid low purity oxygen in stream 88. The remaining portion of stream 85, which could be all of stream 85 if no liquid product is recovered, is passed in stream 86 to main heat exchanger 18 wherein it is vaporized by indirect heat exchange with incoming feed air. Resulting vaporized low purity oxygen is recovered as product low purity oxygen gas in stream 87.

Figure 3:
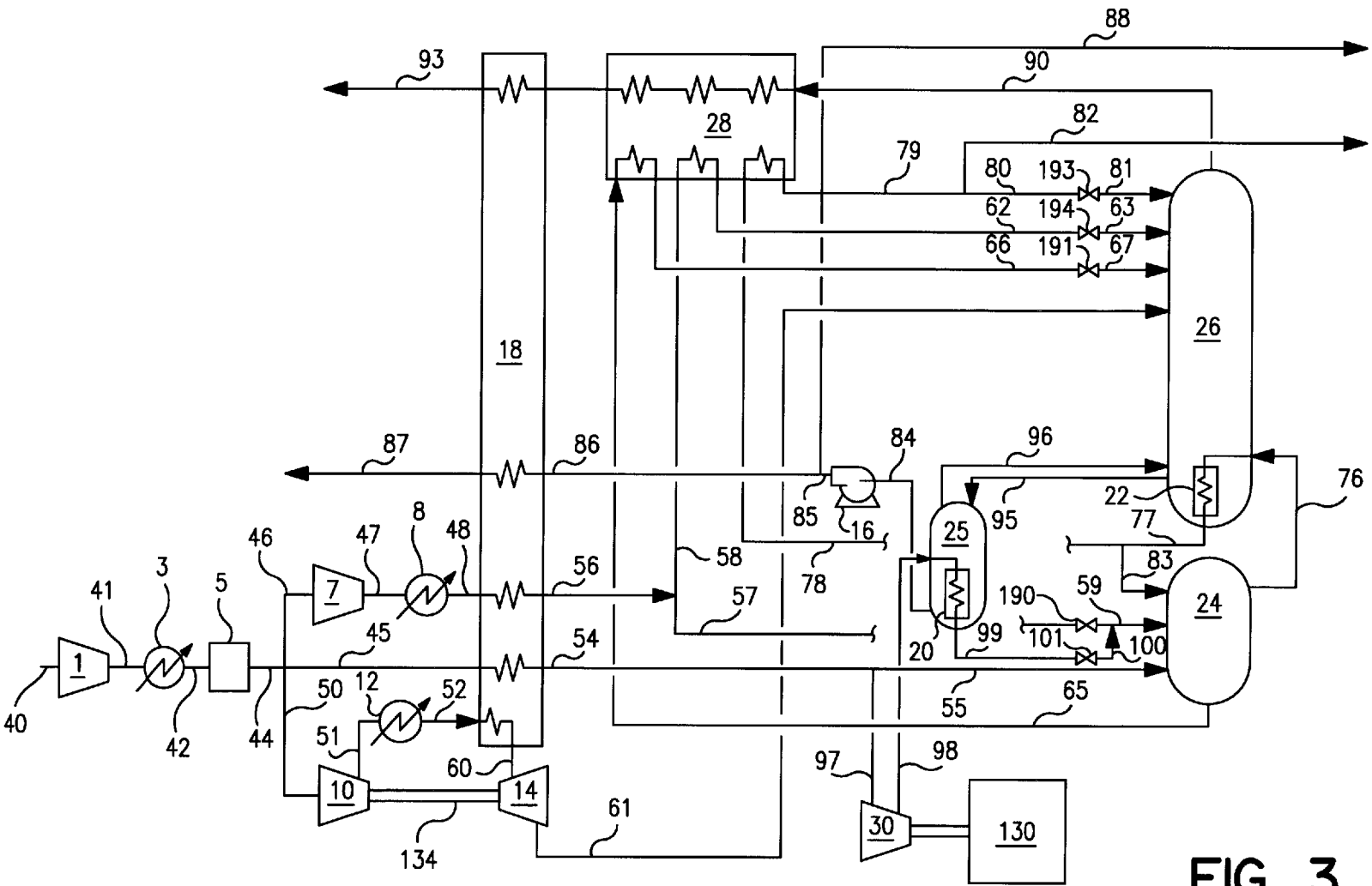
FIG. 3 is a schematic representation of another preferred embodiment of the invention employing cold compressed feed air for reboiling the auxiliary column.

The primary benefit of the cold compression arrangement of the invention is that it eliminates the link between the pressure of the fluid driving the auxiliary column reboiler and the higher pressure column. That is, the air feed to the higher pressure column can now be lower in pressure, thereby reducing power. Compression of a cold vapor requires considerably less energy than compression of an ambient temperature stream. On the other hand, cold compression requires a commensurate increase in turbine refrigeration. To optimize power for the embodiment of this invention illustrated in FIG. 1, the higher pressure column pressure is reduced. To do this, the flow of stream 70 is increased (this reduces the oxygen content in the base of column 26). Increasing the flow of stream 70 increases cold compressor power which increases the flow through turbine 14. The lower pressure of column 24 also increases the flow through turbine 14. The use of feed air in the cold compressor such as is illustrated in FIG. 3 requires less power (lower pressure and lower flow of air needed in reboiler 20) and less compensating turbine refrigeration. However, the liquefaction of the large air stream makes this configuration less efficient than that illustrated in FIG. 1. The optimum column 24 pressure is higher for the FIG. 3 configuration than for the FIG. 1 configuration because the oxygen recovery falls off at a higher pressure. By cold compressing the intermediate column 24 fluid, less cold compression energy is required than would be with nitrogen from the top of the column while the recovery potential isn't compromised as it is with air.

The results of an example of the invention in accordance with the embodiment of the invention illustrated in FIG. 1 is presented in Table 1. This example is presented for illustrative purposes and is not intended to be limiting. The stream numbers of Table 1 correspond to those of FIG. 1.

TABLE 1

| Stream | Normalized Flow, mol/h | Pressure, psia | Temperature, K. | Mole % $O_2$ |
|---|---|---|---|---|
| 44 | 100 | 47.1 | 291.5 | 21.0 |
| 48 | 27.1 | 280 | 298.2 | 21.0 |
| 57 | 12.5 | 278 | 93.8 | 21.0 |
| 58 | 14.6 | 278 | 93.8 | 21.0 |
| 61 | 31.1 | 19.8 | 85.0 | 21.0 |
| 71 | 21.1 | 67.9 | 104.4 | 4.4 |
| 74 | 3.7 | 43.0 | 88.2 | 4.4 |
| 76 | 24.9 | 43.0 | 88.2 | 1.7 |
| 82 | 0 | — | — | — |
| 87 | 21.3 | 114 | 292.4 | 95.0 |
| 88 | 0 | — | — | — |
| 93 | 78.7 | 16.4 | 292.4 | 0.9 |

Figure 2:
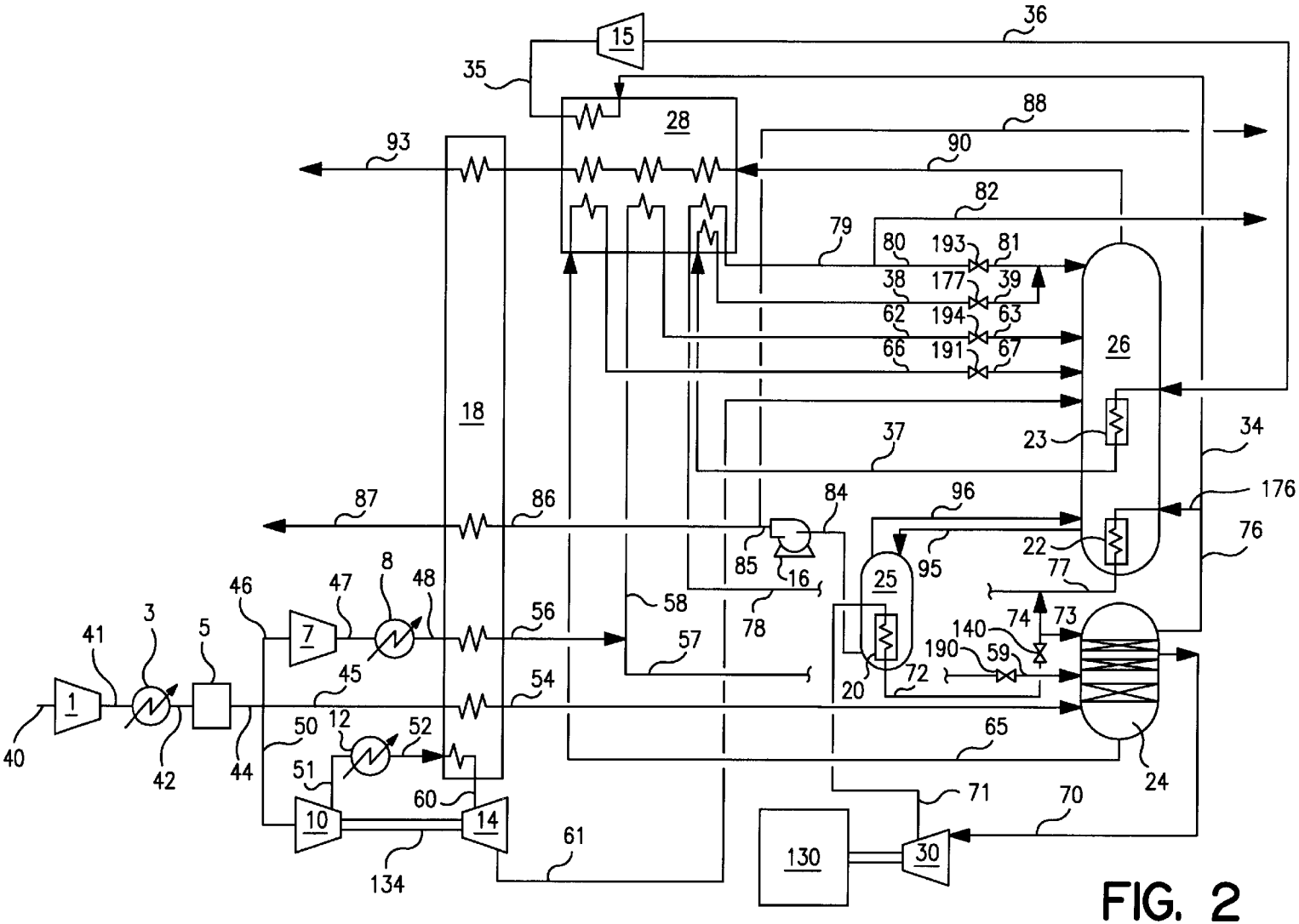
FIG. 2 is a schematic representation of another preferred embodiment of the invention similar to that of the embodiment illustrated in FIG. 1 and additionally employing shelf vapor turboexpansion.

FIG. 2 illustrates another embodiment of the invention wherein, in addition to the cold compression of the reboiling fluid a portion of the nitrogen-enriched fluid is turboexpanded and condensed in an intermediate reboiler. The numerals of FIG. 2 are the same as those of FIG. 1 for the common elements, and these common elements will not be described again in detail.

Referring now to FIG. 2, only a portion of nitrogen-enriched vapor 76, shown as stream 176, is passed into reboiler 22. The remaining portion 34 of nitrogen-enriched vapor 76 is preferably warmed by partial traverse of heat exchanger 28 and resulting nitrogen-enriched vapor stream 35 is passed to turboexpander 15 wherein it is turboexpanded to generate refrigeration. Resulting refrigeration bearing turboexpanded nitrogen-enriched vapor in stream 36 is passed to intermediate reboiler 23 wherein it is condensed by indirect heat exchange with lower pressure column descending liquid thus generating additional upflow vapor for the operation of lower pressure column 26. In the embodiment of the invention illustrated in FIG. 2 intermediate reboiler 23 is shown as being physically within column 26 although it is understood that this reboiler could also be located outside of column 26. Intermediate reboiler 23 vaporizes column liquid taken from above the bottom of column 26, generally from within the range of from 3 to 12 equilibrium stages above the bottom of column 26. Resulting condensed nitrogen-enriched liquid from intermediate reboiler 23 is passed in stream 37 to heat exchanger 28 wherein it is subcooled and from there it is passed into the upper portion of lower pressure column 26 as additional reflux. In the embodiment of the invention illustrated in FIG. 2, the subcooled nitrogen-enriched liquid is withdrawn from heat exchanger 28 in stream 38, passed through valve 177 and then in stream 39 combined with stream 81 for passage into column 26.

FIG. 3 illustrates another embodiment of the invention wherein a portion of the cooled feed air rather than reboiling fluid from the higher pressure column undergoes cold compression and is then used to drive the auxiliary column bottom reboiler. The numerals of FIG. 3 are the same as the numerals of FIG. 1 for the common elements, and these common elements will not be described again in detail.

Referring now to FIG. 3, the feed air, as in the embodiment illustrated in FIG. 1, is cooled in main heat exchanger 18 by indirect heat exchange with return streams and emerges from main heat exchanger 18 as cooled feed air in streams 54, 56 and 60. However, in the embodiment of the invention illustrated in FIG. 3, only a portion 55 of cooled feed air stream 54 is passed directly into higher pressure column 24. Another portion 97 of cooled feed air stream 54 is passed to cold compressor 30 wherein it is cold compressed to an increased pressure within the range of from 40 to 80 psia to form cold compressed feed air stream 98. Generally the pressure of cold compressed feed air stream 98 will exceed the pressure of cooled feed air portion 97 by at least 5 psi.

Cold compressed feed air portion 98 is passed to bottom reboiler 20 wherein it is condensed by indirect heat exchange with low purity oxygen liquid. A portion of the low purity oxygen liquid is vaporized by this heat exchange to provide the upflowing vapor for the operation of auxiliary column 25. Resulting condensed feed air is withdrawn from bottom reboiler 20 in stream 99 reduced in pressure by passage through valve 101 and then passed into higher pressure column 24 for separation. In the embodiment of the invention illustrated in FIG. 3 the feed air 100 from valve 101 is combined with stream 59 and as such passed into higher pressure column 24.

Figure 4:
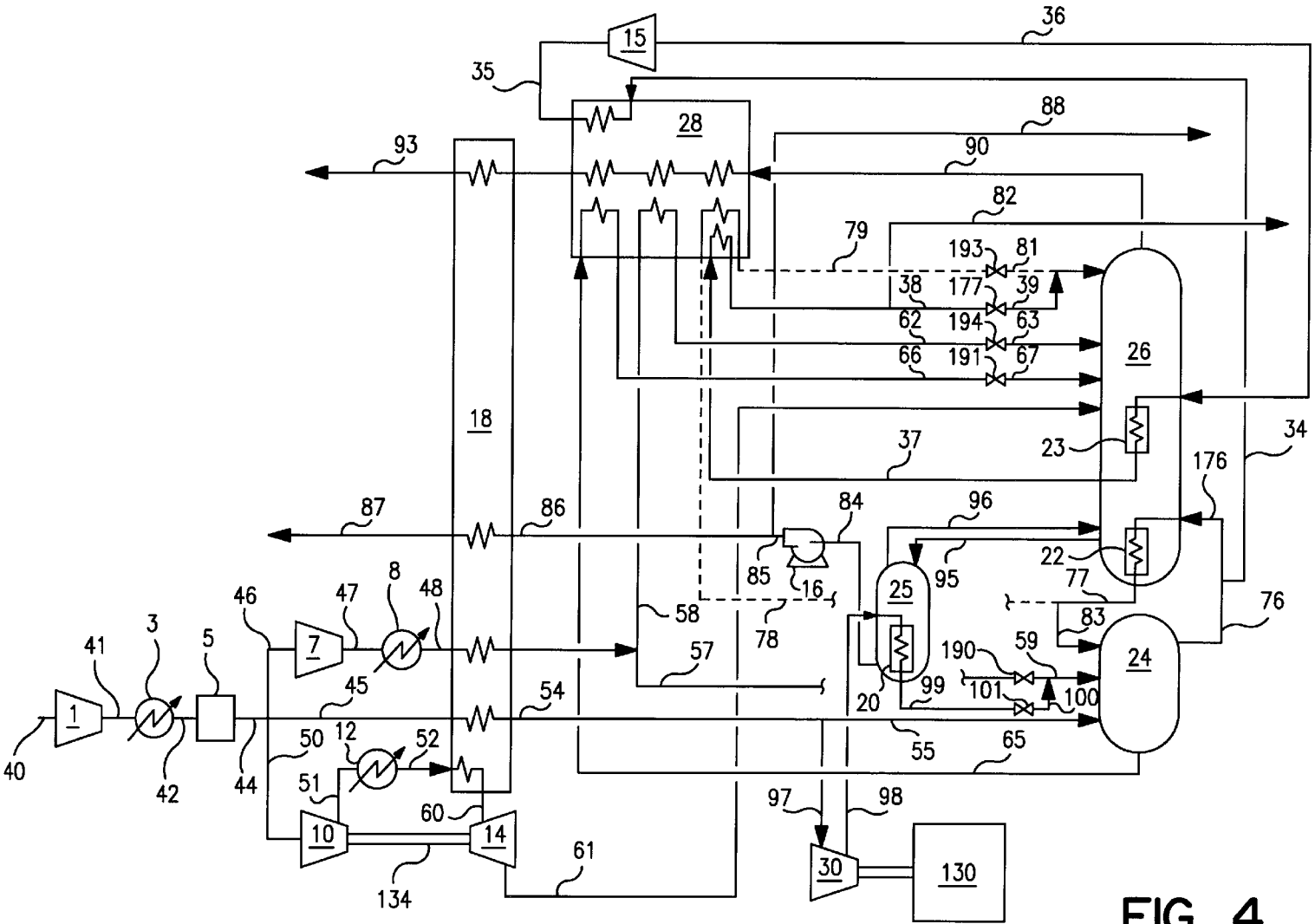
FIG. 4 is a schematic representation of another preferred embodiment of the invention employing shelf vapor turboexpansion.

FIG. 4 illustrates another embodiment of the invention which employs the shelf vapor turboexpansion of the embodiment illustrated in FIG. 2 with the feed air cold compression illustrated in FIG. 3. The numerals in FIG. 4 are the same as those in FIGS. 2 and 3 for the common elements and these common elements will not be discussed again in detail. In the embodiment of the invention illustrated in FIG. 4, most or all of the reflux requirements for lower pressure column 26 can be supplied from nitrogen-enriched fluid stream 34. Accordingly, the nitrogen-enriched liquid in streams 78, 79 and 81, which is used in the other illustrated embodiments of the invention to supply reflux liquid to column 26, is shown in dotted line form in the embodiment illustrated in FIG. 4 to show the optional nature of the use of these streams.

Although the invention has been described in detail with reference to certain preferred embodiments, those skilled in the art will recognize that there are other embodiments of the invention within the sprit and the scope of the claims.

What is claimed is:

1. A method for producing low purity oxygen comprising:

(A) passing feed air into a higher pressure column and separating the feed air within the higher pressure column by cryogenic rectification into nitrogen-enriched fluid and oxygen-enriched fluid;

(B) passing nitrogen-enriched fluid and oxygen-enriched fluid from the higher pressure column into a lower pressure column and producing oxygen-richer fluid by cryogenic rectification within the lower pressure column;

(C) passing oxygen-richer fluid into the upper portion of an auxiliary column and producing low purity oxygen fluid in the lower portion of the auxiliary column;

(D) withdrawing reboiling fluid from an intermediate level of the higher pressure column, increasing the pressure of the withdrawn reboiling fluid by cold compression, and vaporizing a portion of the low purity oxygen fluid by indirect heat exchange with the increased pressure withdrawn reboiling fluid; and (E) recovering low purity oxygen fluid from the lower portion of the auxiliary column as product low purity oxygen.

2. The method of claim 1 wherein the intermediate level is from 1 to 15 equilibrium stages below the top of the higher pressure column.

3. The method of claim 1 wherein the cold compression increases the pressure of the withdrawn reboiling fluid by at least 10 psi.

4. The method of claim 1 wherein the increased pressure reboiling fluid is condensed by the indirect heat exchange with the low purity oxygen fluid, and the resulting condensed reboiling fluid is passed into both the higher pressure column and the lower pressure column.

5. The method of claim 1 further comprising turboexpanding a portion of the nitrogen-enriched fluid, condensing the turboexpanded nitrogen-enriched fluid, and passing the condensed turboexpanded nitrogen-enriched fluid into the lower pressure column.

6. Apparatus for producing low purity oxygen comprising:

(A) a higher pressure column and means for passing feed air into the higher pressure column;

(B) a lower pressure column and means for passing fluid from the higher pressure column into the lower pressure column;

(C) an auxiliary column having a bottom reboiler, and means for passing fluid from the lower portion of the lower pressure column into the upper portion of the auxiliary column;

(D) a cold compressor, means for passing fluid from an intermediate level of the higher pressure column to the cold compressor, and means for passing fluid from the cold compressor to the auxiliary column bottom reboiler; and (E) means for recovering product low purity oxygen from the lower portion of the auxiliary column.

7. The apparatus of claim 6 wherein the intermediate level is from 1 to 15 equilibrium stages below the top of the higher pressure column.

8. The apparatus of claim 6 further comprising means for passing fluid from the auxiliary column bottom reboiler into both the higher pressure column and the lower pressure column.

9. The apparatus of claim 6 further comprising a turboexpander and an intermediate reboiler associated with the lower pressure column, and further comprising means for passing fluid from the upper portion of the higher pressure column to the turboexpander, means for passing fluid from the turboexpander to the intermediate reboiler, and means for passing fluid from the intermediate reboiler to the lower pressure column.

10. A method for producing low purity oxygen comprising:

(A) cooling feed air in a main heat exchanger to produce cooled feed air, passing a portion of the cooled feed air into a higher pressure column, and separating the feed air within the higher pressure column by cryogenic rectification into nitrogen-enriched fluid and oxygen-enriched fluid;

(B) passing nitrogen-enriched fluid and oxygen-enriched fluid from the higher pressure column into a lower pressure column and producing oxygen-richer fluid by cryogenic rectification within the lower pressure column;

(C) passing oxygen-richer fluid into the upper portion of an auxiliary column and producing low purity oxygen fluid in the lower portion of the auxiliary column;

(D) increasing the pressure of another portion of the cooled feed air by cold compression, and vaporizing a portion of the low purity oxygen fluid by indirect heat exchange with the increased pressure feed air portion; and (E) recovering low purity oxygen fluid from the lower portion of the auxiliary column as product low purity oxygen.

11. The method of claim 10 wherein the cold compression of the cooled feed air increases the pressure of the cooled feed air by at least 5 psi.

12. Apparatus for producing low purity oxygen comprising:

(A) a main heat exchanger, a higher pressure column, means for passing feed air to the main heat exchanger, and means for passing feed air from the main heat exchanger to the higher pressure column;

(B) a lower pressure column and means for passing fluid from the higher pressure column into the lower pressure column;

(C) an auxiliary column having a bottom reboiler, and means for passing fluid from the lower portion of the lower pressure column into the upper portion of the auxiliary column;

(D) a cold compressor, means for passing feed air from the main heat exchanger to the cold compressor, and means for passing feed air from the cold compressor to the auxiliary column bottom reboiler; and (E) means for recovering product low purity oxygen from the lower portion of the auxiliary column.

13. The apparatus of claim 12 further comprising a turboexpander and an intermediate reboiler associated with the lower pressure column, and further comprising means for passing fluid from the upper portion of the higher pressure column to the turboexpander, means for passing fluid from the turboexpander to the intermediate reboiler, and means for passing fluid from the intermediate reboiler to the lower pressure column.

* * * * *